US007047802B2

(12) United States Patent
Seys et al.

(10) Patent No.: US 7,047,802 B2
(45) Date of Patent: May 23, 2006

(54) PUMP TESTER

(75) Inventors: Andrew C. Seys, Scottsdale, AZ (US); James Wynn, Glendale, AZ (US); Judith A. Wallis, Chandler, AZ (US); Kim Maria O'Connor, Phoenix, AZ (US); Jerry TerLaan, Mesa, AZ (US); Christie S. Parker, Tempe, AZ (US); Debra Butterworth, Scottsdale, AZ (US)

(73) Assignee: The Dial Corporation, Scottsdale, AZ (US)

( * ) Notice: Subject to any disclaimer, the term of this patent is extended or adjusted under 35 U.S.C. 154(b) by 190 days.

(21) Appl. No.: 10/724,026

(22) Filed: Nov. 26, 2003

(65) Prior Publication Data

US 2005/0109099 A1 May 26, 2005

(51) Int. Cl.
*B05B 1/26* (2006.01)

(52) U.S. Cl. ..... 73/168

(58) Field of Classification Search ..... 73/865.6, 73/865.3, 168, 1.36, 865.9; 417/63
See application file for complete search history.

(56) References Cited

U.S. PATENT DOCUMENTS

| | | | | | |
|---|---|---|---|---|---|
| 2,826,067 | A * | 3/1958 | Braunlich | 73/168 |
| 3,459,049 | A * | 8/1969 | Kamps | 73/865.9 |
| 4,502,319 | A * | 3/1985 | Arens | 73/1.27 |
| 4,603,812 | A * | 8/1986 | Stoesser et al. | 239/329 |
| 5,272,917 | A * | 12/1993 | Pippert | 73/168 |
| 5,827,983 | A * | 10/1998 | Ortoli | 73/865.3 |
| 6,581,483 | B1 * | 6/2003 | Yeh | 73/865.3 |
| 2002/0175182 | A1 * | 11/2002 | Matthews | 222/52 |
| 2004/0199296 | A1 * | 10/2004 | Farina et al. | 700/283 |
| 2005/0001054 | A1 * | 1/2005 | Farina et al. | 239/66 |
| 2005/0077369 | A1 * | 4/2005 | Farina et al. | 239/1 |

* cited by examiner

*Primary Examiner*—Robert Raevis
(74) *Attorney, Agent, or Firm*—Snell & Wilmer LLP

(57) ABSTRACT

An automatic pump testing device is configured with controller, a pump testing station, a supply tank and a collection tank. In accordance with one aspect of the present invention, a pump testing device is configured to test various types of hand actuated pumps. In accordance with another aspect of the present invention, the pump testing device is configured to test various end of life modes, length of life, and other pump performance information, including pump performance information measured over time.

29 Claims, 5 Drawing Sheets

PUMP TESTER

FIELD OF INVENTION

The present invention generally relates to pump testing devices and, more particularly, to an automated pump testing device.

BACKGROUND OF THE INVENTION

Hand actuated pump devices are desirable for conveniently dispensing a product. Various structures have been designed for the purpose of dispensing a product. For example, some hand actuated pump devices are used to dispense liquid hand soap. Furthermore, some hand actuated pump devices cause the hand soap to be dispensed as a foam. In other examples, hand actuated pumps spray a product, such as a window cleaning fluid. Various hand actuated pump configurations exist, including hand actuated pumps that are pulled like a trigger or hand actuated pumps that are pushed linearly.

Regardless of the type of hand actuated pump or the method of actuation, it is desirable to test the hand actuated pump devices to determine how well these devices perform under various circumstances. In the past, such testing has largely been performed manually. However, such manual testing may be subject to human error, can be inefficient, may result in imprecise measurement of performance information, and may involve delayed feedback. Thus, a need exists for an automated pump testing device that overcomes these and other limitations of the prior art.

SUMMARY OF THE INVENTION

While the way that the present invention addresses the disadvantages of the prior art is discussed in greater detail below, in general, the present invention provides an automatic pump testing device having a controller, a pump testing station, a supply tank and a collection tank. The controller is configured to control the pump testing and to receive performance information from the pump testing station.

Performance information may include length of life testing. In accordance with one aspect of the present invention, a pump testing device is configured to test various types of hand actuated pumps. In accordance with another aspect of the present invention, the pump testing device is configured to test various end of life modes, length of life, and other pump performance information, including pump performance information measured over time.

BRIEF DESCRIPTION OF THE DRAWINGS

A more complete understanding of the present invention may be derived by referring to the detailed description and claims when considered in connection with the Figures, where like reference numbers refer to similar elements throughout the Figures, and:

DETAILED DESCRIPTION

The following description is of exemplary embodiments of the invention only, and is not intended to limit the scope, applicability or configuration of the invention in any way. Rather, the following description is intended to provide a convenient illustration for implementing various embodiments of the invention. As will become apparent, various changes may be made in the function and arrangement of the elements described in these embodiments without departing from the scope of the invention as set forth in the appended claims. For example, in the context of the present invention, the method and apparatus hereof find particular use in connection with soap dispensers. However, generally speaking, various liquid/fluid products that can be drawn from a reservoir and dispensed by a hand actuated pump (hereinafter "pump") such as surface cleaners, automotive oil, powders, foods (e.g., ketchup/mustard), laundry treating products, insecticides, deodorizers, sanitizers, and/or the like are suitable for use in accordance with the present invention. Likewise, though various portions of the specification refer to plunger type pumps as the hand actuated pump to be tested, other pumps now known or as yet unknown, should be considered within the scope of the present invention.

Figure 1:
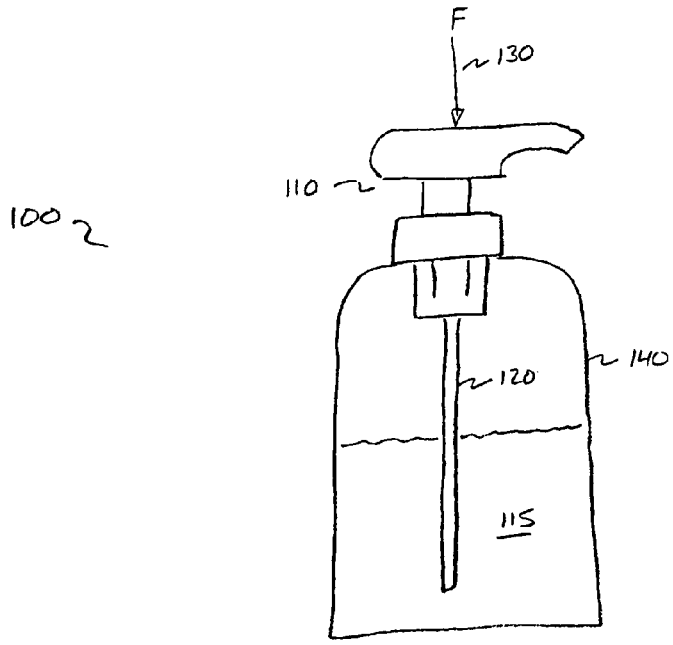
FIGS. 1 and 2 are cross-sectional views of exemplary hand actuated pump devices that may be tested in accordance with an exemplary embodiment of the present invention.

In general, in accordance with various exemplary embodiments of the present invention, an automated hand actuated pump testing device ("tester") is configured to test a pump in an automated manner. The tester may be configured to test various types of pumps. Briefly, the term "pump" includes various mechanical systems that are configured to withdraw a liquid/fluid substance from a reservoir and dispense that substance. Such pumps are well known and will not be described in detail. Nevertheless, by way of example, FIG. 1 illustrates an exemplary plunger style pump 100 where a plunger 110 is linearly depressed to draw a liquid/fluid product 115 from a reservoir 140 up a tube 120 and to dispense the product. In this exemplary embodiment, plunger 110 is depressed in a vertical manner with a downward force 130. A hand soap dispenser is one typical plunger type pump. In addition, exemplary pump 100 further includes a device for causing the soap to become foamy.

Figure 2:
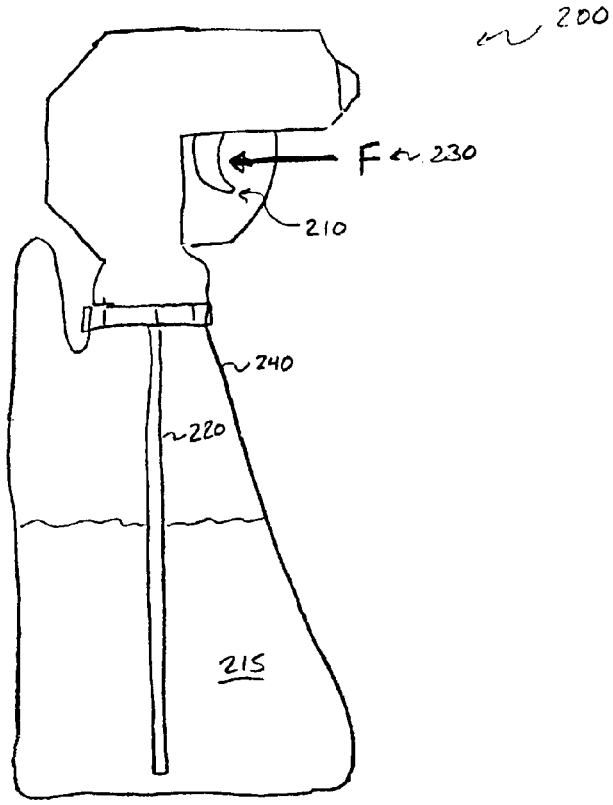
Figure 6:
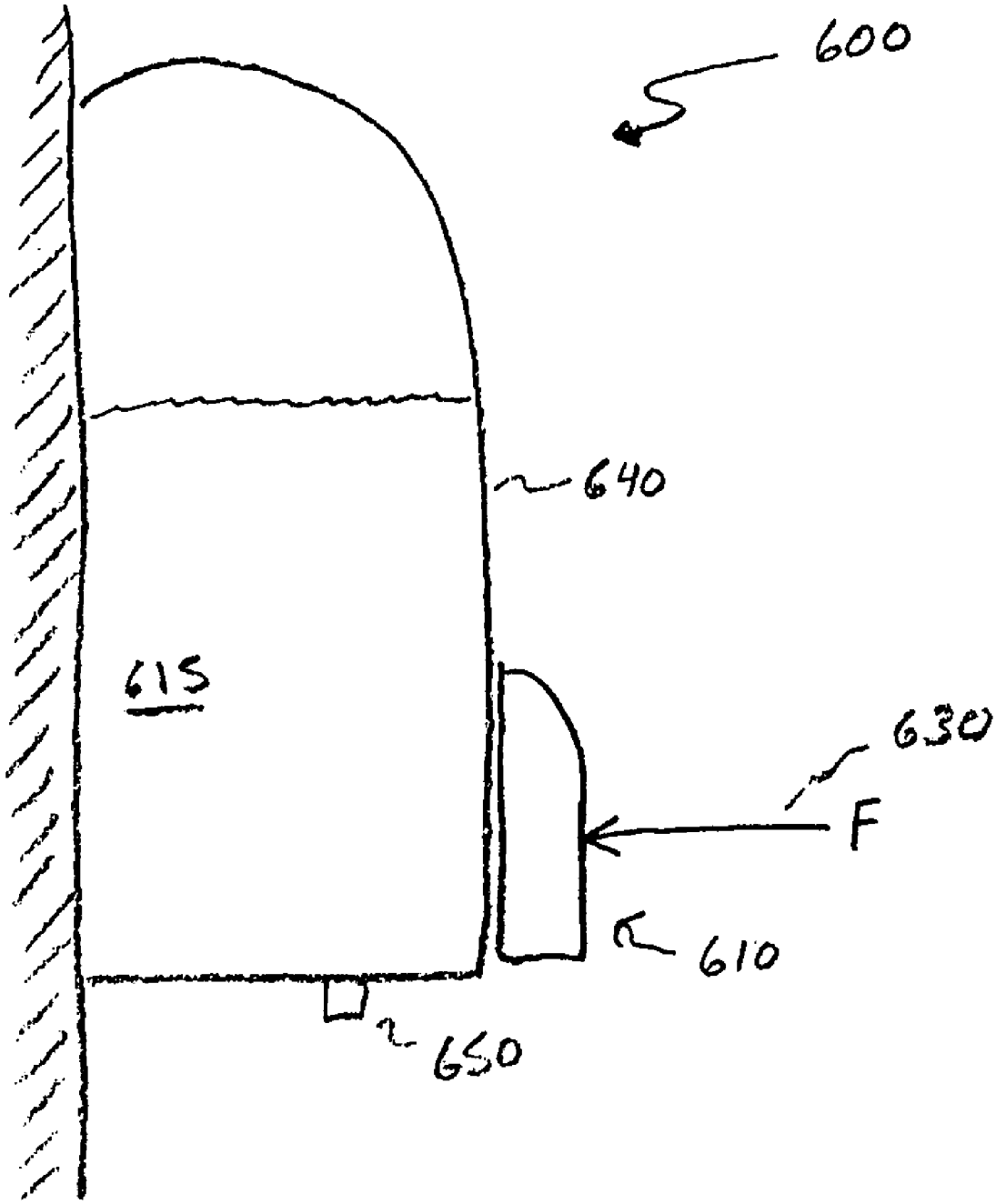
FIG. 6 is a cross-sectional view of another exemplary hand actuated pump device that may be tested in accordance with an exemplary embodiment of the present invention.

Furthermore, FIG. 2 illustrates an exemplary trigger type pump 200 where a trigger 210 is pulled to draw a liquid/fluid product 215 from a reservoir 240 up a tube 220 and to dispense the product. In this exemplary embodiment, trigger 210 is pulled in a horizontal direction with a force 230. A window cleaner spray bottle is one typical trigger type pump. By way of yet another exemplary embodiment, FIG. 6 illustrates an exemplary wall mounted liquid dispenser type pump 600 where a button 610 is pushed to cause a liquid/fluid product 615 from a reservoir 640 to be dispensed at 650. In this exemplary embodiment, button 610 is pushed in a horizontal direction with a force 630. In addition, in accordance with various exemplary embodiments of the present invention, a hand actuated pump may be a contactless type pump. For example, an infra-red type pump may be configured to dispense a product without physical contact with the dispenser. In this regard, a hand or other object moving within the path of an infra-red beam or other detection sensor may cause the pump to dispense a product.

Thus, the pumps may be configured to dispense the fluid in a variety of different ways including spraying, squirting, foaming, or other known dispensing methods. Furthermore, as used herein, the term pump includes other devices configured to withdraw and dispense a liquid/fluid from a reservoir by hand actuation of the device. In addition, the pumps may be actuated in various different ways.

That being said, in accordance with one aspect of the present invention, the tester is configured to test a plunger type pump, a trigger type pump, or a contact-less type of pump. In addition, the tester may be configured to be adjustable to selectively test two or more types of pumps. Furthermore, the tester may be configured to test pumps of various other actuation types regardless of whether the pump is a push or pull type pump and regardless of the angle of the actuation force.

Figure 3:
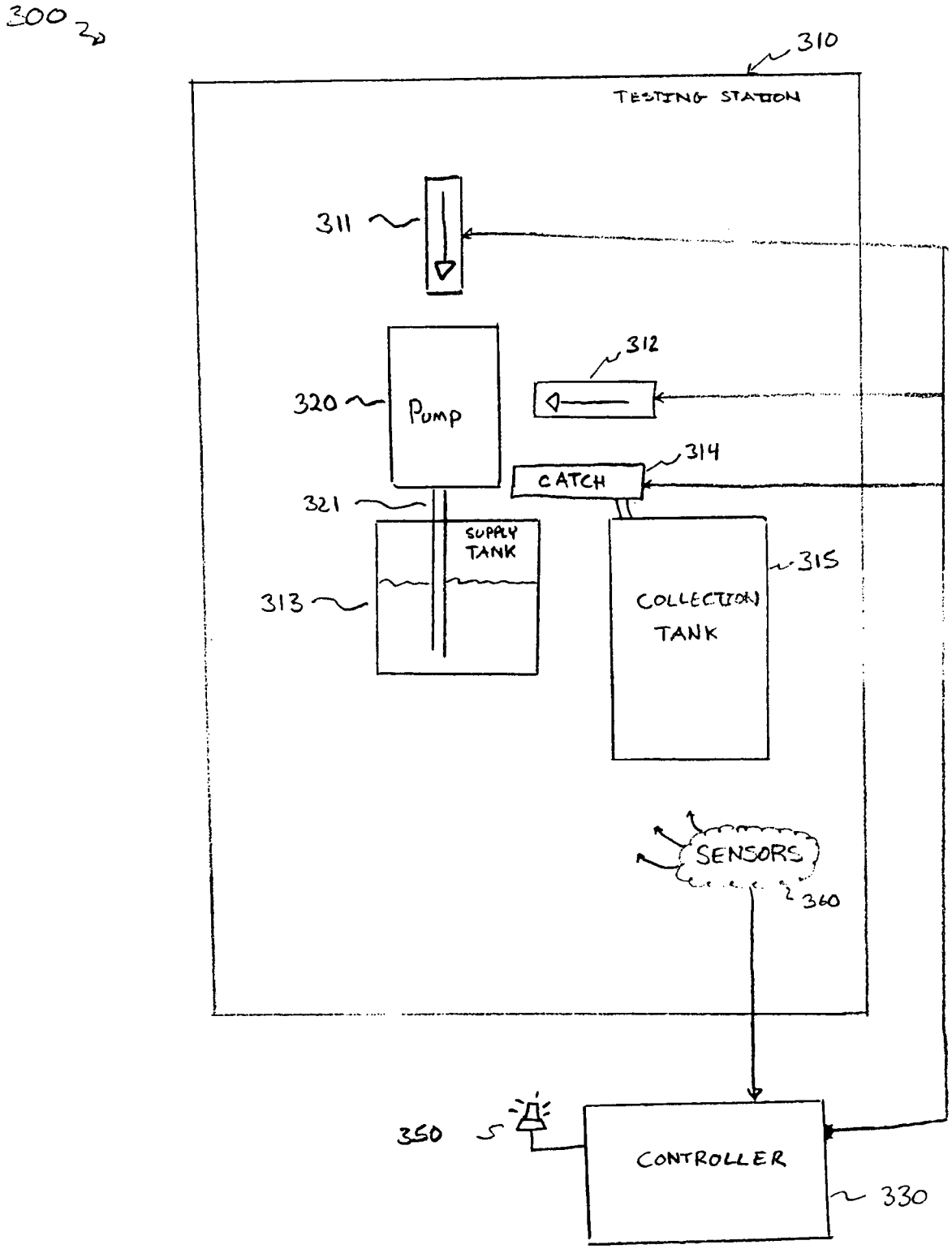
FIG. 3 is an exemplary pump testing system in accordance with an exemplary embodiment of the present invention.

FIG. 3 illustrates a pump testing system 300 in accordance with an exemplary embodiment of the present invention. Pump testing system 300 includes a testing station 310 and a controller 330 configured to communicate with pump testing station 310. Testing station 310 is further configured to include one or more pump actuators (e.g., 311 or 312). Testing station 310 may further be configured to facilitate a larger than normal supply of a product dispensed and/or to facilitate capture or containment of the dispensed product. For example, testing station 310 may be configured to include a supply tank 313, a catch 314, and a collection tank 315.

In accordance with one aspect of the present invention, pump actuator (e.g., 311 or 312) is configured to physically actuate a pump, simulating hand actuation of the pump. Thus, a pump actuator (e.g., 311 or 312) is a device that is configured to create a force in a desired direction. In accordance with one exemplary embodiment of the present invention, pump actuator 311 may comprise a servo or a hydraulic piston that is configured to create a downward force. Similarly, in another exemplary embodiment, pump actuator 312 is configured to create a sideways force. As briefly mentioned above, in accordance with various exemplary embodiments of the present invention, the force may be either a push or a pull force. Other devices that create a controlled force may also be used as a pump actuator. Furthermore, as discussed herein, the pump may be an infra-red actuated dispenser of the type where a product is dispensed without contact with the dispenser. In this exemplary embodiment, pump actuator 312 may comprise a moving object configured to move in the path of the infra red sensor and to cause the dispenser to dispense a product. Thus, in accordance with one exemplary embodiment of the present invention, the moving object may simulate a hand movement activating the dispenser.

Furthermore, in accordance with various exemplary embodiments of the present invention, testing station 310 is configured with only one pump actuator that is configured to be adjustable between two or more positions. Thus, a single pump actuator may be configured to be adaptable to various types of pumps, including a pump that is actuated at an angle other than a vertical or horizontal actuation. In one exemplary embodiment, the variable positioning of the pump actuator is facilitated through use of a pivot arm holding the actuator. The pivot arm may be manually set or may be controlled externally by automation command. Thus, in one exemplary embodiment of the present invention, testing station 310 is configured to actuate a pump at a desired angle.

In this regard, a pump 320 is held in position to receive the actuation force. Any device may be used that suitably holds pump 320 in a stable position. For example, a C-clamp may be used to hold pump 320 in proximity to actuator 311. In accordance with various exemplary embodiments, pump 320 includes a tube 321 for drawing a liquid from a reservoir. Because pumps are often re-used with multiple re-fill bottles, and in order to test the performance limits of the pumps, in accordance with one aspect of the present invention testing station 310 has a seemingly infinite reservoir. In one exemplary embodiment, testing station 310 is configured with a supply tank 313. Supply tank 313 may be configured to hold a large volume of liquid of the type for which the pump is to be tested.

In accordance with another exemplary embodiment of the present invention, the fluid holding capacity of supply tank 313 is not necessarily large and testing system 300 is configured to replace the liquid that is removed from supply tank 313 at approximately the same time that the liquid is removed. For example, a level sensor or float may be used to replace the fluid withdrawn from supply tank 313. The level sensor may, for example, be a fiber optic amplifier with, for example, high and low level sensors. In another example, the fluid dispensed by pump 320 is re-circulated to supply tank 313. Thus, supply tank 313 may act as an infinite reservoir. In yet other exemplary embodiments, supply tank 313 contains a sufficiently large quantity of fluid that no make up fluid is added to the tank.

In accordance with a further exemplary embodiment, supply tank 313 is the reservoir of the pump bottle that is normally used with the pump. In this example, the pump bottle may be tested until the contents are exhausted, or the pump bottle may be modified to receive a replacement fluid. A replacement fluid may be provided to the reservoir, for example, by use of optical level sensors as described herein. In one exemplary embodiment, an optical level sensor detects that the fluid level in the reservoir has reached a low level and causes a make up fluid to be added to the reservoir until an optical level sensor detects that the fluid level has reached a high level. The fluid may be added, for example, through a hole in the reservoir or via other suitable configurations.

In addition, in accordance with one aspect of the present invention, testing station 310 simulates actual pump conditions by drawing the fluid approximately the same height as the tested pump would experience under actual use conditions. For example, in accordance with various exemplary embodiments, testing station 310 is configured tube 321 is approximately the same length as a tube (e.g., 120 or 220) in actual use. Furthermore, the low level of supply tank 313 may be configured to be above the bottom of tube 321. In addition, intermediate supply tanks and other configurations may facilitate simulation of a constant pumping height.

In accordance with another aspect of the present invention, the dispensed product is captured and/or feedback is obtained related to the dispensed product. Capture of the dispensed product may, for example, facilitate a determination of the amount of product that is dispensed with each actuation of the pump, or over time. In one embodiment of the present invention, for example, testing station 310 is further configured with a catch 314. Catch 314 is configured to receive all, or a portion, of the product dispensed by pump 313. In this regard, catch 314 may be configured to receive the product in the form of a spray, a squirt, or another form in which the product is pumped out of supply tank 320. Thus, catch 314 has a suitable shape or size for the purpose of receiving the dispensed product. In accordance with one exemplary embodiment of the present invention, catch 314 has a funnel like shape. In another exemplary embodiment, catch 314 is configured with a flat vertical surface for receiving a spray and a funnel at the bottom end of the flat surface for receiving the run-off product. Furthermore, in accordance with various exemplary embodiments, catch 314 is configured to catch the product that drips from the pump. Such drip product may be separately collected or collected with the non-drip dispensed product.

In another exemplary embodiment of the present invention, testing station 310 further includes a collection tank 315 configured to receive the product captured by catch 314. Collection tank 315 may be configured with an over-flow sensor, level warning sensors, or the like.

In accordance with one aspect of the present invention, pump testing system 300 is controlled by setting various inputs to pump testing system 300 at desired levels and/or varying the inputs to simulate desired testing conditions. For example, the angle, strength, and rate of application of the actuation force may be set and/or varied. For example, pump testing system 300 includes a controller 330 that is configured to control the actuation of a pump in testing station 310.

In one exemplary embodiment, controller 330 is configured to communicate with various positioning components that are configured to adjust the position and/or angle of actuation of pump actuation component(s) (e.g., pump actuators 311 or 312). Such positioning components may include servos, hydraulics, and other positioning devices. Furthermore, controller 330 may be configured to communicate with pump actuators 311 and/or 312 to control the amount of force created by the pump actuators and the rate of the actuation (e.g., the distance traveled by the actuator divided by the time to actuate the pump). In other exemplary embodiments, controller 330 is also configured to control the completeness of the actuation. For example, the actuation of the pump with less than a complete actuation simulates a partial squeeze of the pump trigger. Furthermore, controller 330 may be configured to cause the actuator to over-squeeze the trigger to simulate an overly aggressive use of the pump. In this regard, the movement of the actuator may be set by controller 330 and/or may be set manually.

In yet further exemplary embodiments of the present invention, controller 330 is configured to set and/or adjust the number of actuations per pump test cycle and/or the time between pump actuations in a pump test cycle. By way of example, a pump test cycle may include four quick squeezes of the pump trigger, thus simulating normal use of a pump to dispense window washing fluid. Furthermore, controller 330 may be configured to set and/or adjust the interval between pump test cycles.

Not only is controller 330 configured to control testing station 310, but in accordance with another aspect of the present invention, controller 330 is configured to receive performance information from pump testing station 310, to record the performance information, and/or to modify the commands sent by controller 330 to testing station 310 as a result of the performance information that is received. For example, controller 330 may be configured to receive information from pump testing station 310 representing the amount of material dispensed by the hand actuated pump, the end of life of the pump, the length of life, what caused the end of life of the pump, the resistance of the pump to actuation, and/or the amount of product drip between test cycles. Other performance related information may also be communicated to controller 330.

In this regard, testing station 310 further includes one or more sensors for measuring such performance information or determining the occurrence of such events. In accordance with one exemplary embodiment of the present invention, a sensor is configured to communicate to controller 330 the weight of the discharged material in the collection tank. Furthermore, the amount of drip material may be separately collected and weighed. An electronic balance, for example, may be used to weigh the drip of discharged material. In other exemplary embodiments, information related to the transport of product from supply tank 313 by pump 320 is obtained by weighing supply tank 313 or the collection tank 315, flow sensors, and/or using level sensors. This performance information is communicated to controller 330. In another exemplary embodiment, a sensor is configured to determine the force of the spray against catch 314 and to communicate that determination to controller 330. Other sensors may also be configured to determine the spread of the spray (i.e., wetted area), the distance of the spray, or the actuation force.

In accordance with another aspect of the present invention, performance information is captured over time. Thus, for example, the performance of the pump can be analyzed and trends identified. For example, in one exemplary embodiment, controller 330 is configured to record the change in the performance information over time. By way of example, testing station 310 may be configured to test the change, over time, in the actuation force. In one example, the range of movement of the actuator is set at a fixed value, and the force that creates that movement is measured over time. In another example, the force is set at a fixed value, e.g., five pounds, and the range of actuator movement is measured over time. Thus, the performance of the pump mechanism may be tested over the life of the pump. All of, or a portion of, the performance information may be stored in a database 460, or a spreadsheet such as Excel, for further manipulation and analysis.

A database may be any type of database, such as relational, hierarchical, object-oriented, and/or the like. Common database products that may be used to implement the databases include DB2 by IBM (White Plains, N.Y.), any of the database products available from Oracle Corporation (Redwood Shores, Calif.), Microsoft Access or MSSQL by Microsoft Corporation (Redmond, Wash.), or any other database product. A database may be organized in any suitable manner, including as data tables or lookup tables. Association of certain data may be accomplished through any data association technique known and/or practiced in the art. For example, the association may be accomplished either manually or automatically. Automatic association techniques may include, for example, a database search, a database merge, GREP, AGREP, SQL, and/or the like. The association step may be accomplished by a database merge function, for example, using a "key field" in each of the manufacturer and retailer data tables. A "key field" partitions the database according to the high-level class of objects defined by the key field. For example, a certain class may be designated as a key field in both the first data table and the second data table, and the two data tables may then be merged on the basis of the class data in the key field. In this embodiment, the data corresponding to the key field in each of the merged data tables is preferably the same. However, data tables having similar, though not identical, data in the key fields may also be merged by using AGREP, for example.

In accordance with various aspects of the present invention, the commands from controller 330 to testing station 310 are pre-programmed, thus automating an entire testing session, comprising many testing cycles. However, controller 330 may also be configured to user input, whereby controller commands are adjusted before or during a testing session. In this regard, and with momentary reference to FIG. 4, controller 430 may be configured to communicate with an operator interface 440. For example, operator interface 440 is configured to send information to controller 430 and to receive and/or display information from controller 430. Controller 330 may furthermore be configured to generate an alarm in the event of equipment malfunction or the occurrence of predefined events. In one exemplary embodiment, alarm 350 is an audible alarm, light, text message, or other signal. For example, an alarm may be triggered if no material is dispensed after a set number of actuations or if only a set amount of material is dispensed over a period of time or after a set number of pulls.

Figure 4:
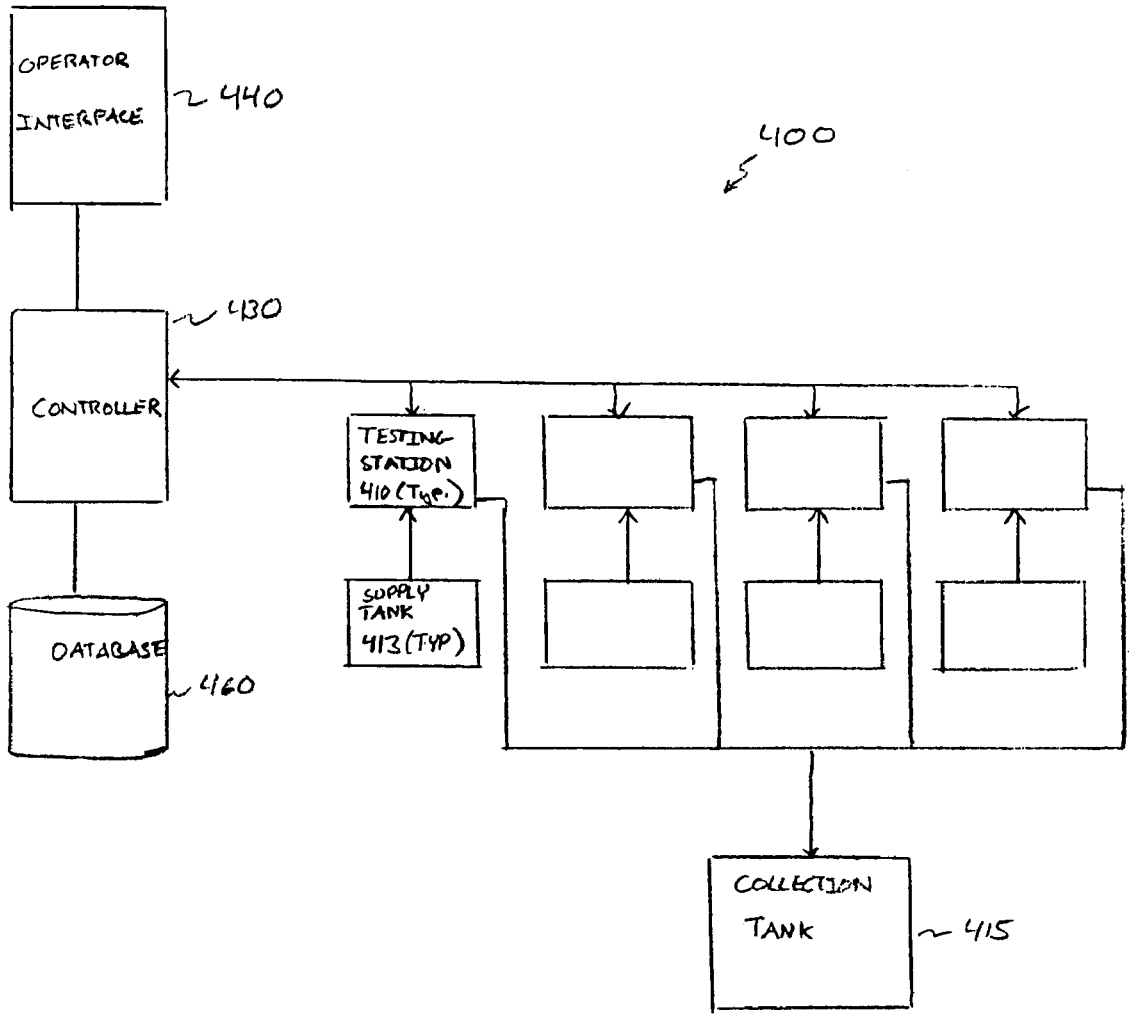
FIG. 4 is another exemplary pump testing system in accordance with an exemplary embodiment of the present invention.

In accordance with another aspect of the present invention, the testing systems may be configured to test multiple pumps in parallel. Parallel testing of pumps may reduce variability from test to test and from person to person. Furthermore, the ability to perform 24-hour a day testing facilitates accelerated length of life testing. In accordance with an exemplary embodiment of the present invention, FIG. 4 illustrates a pump testing system configured with four testing stations 410. In this exemplary embodiment, pump testing system 400 further includes four supply tanks 413 configured with each supply tank supplying a testing station. However, other quantities of supply tanks may be used and may be combined or shared with other quantities of testing stations. Furthermore, various quantities of collection tanks may be associated with the testing stations. For example, FIG.4 llustrates a single collection tank 415 receiving the product output from the pumps of all four testing stations 410.

Figure 5:
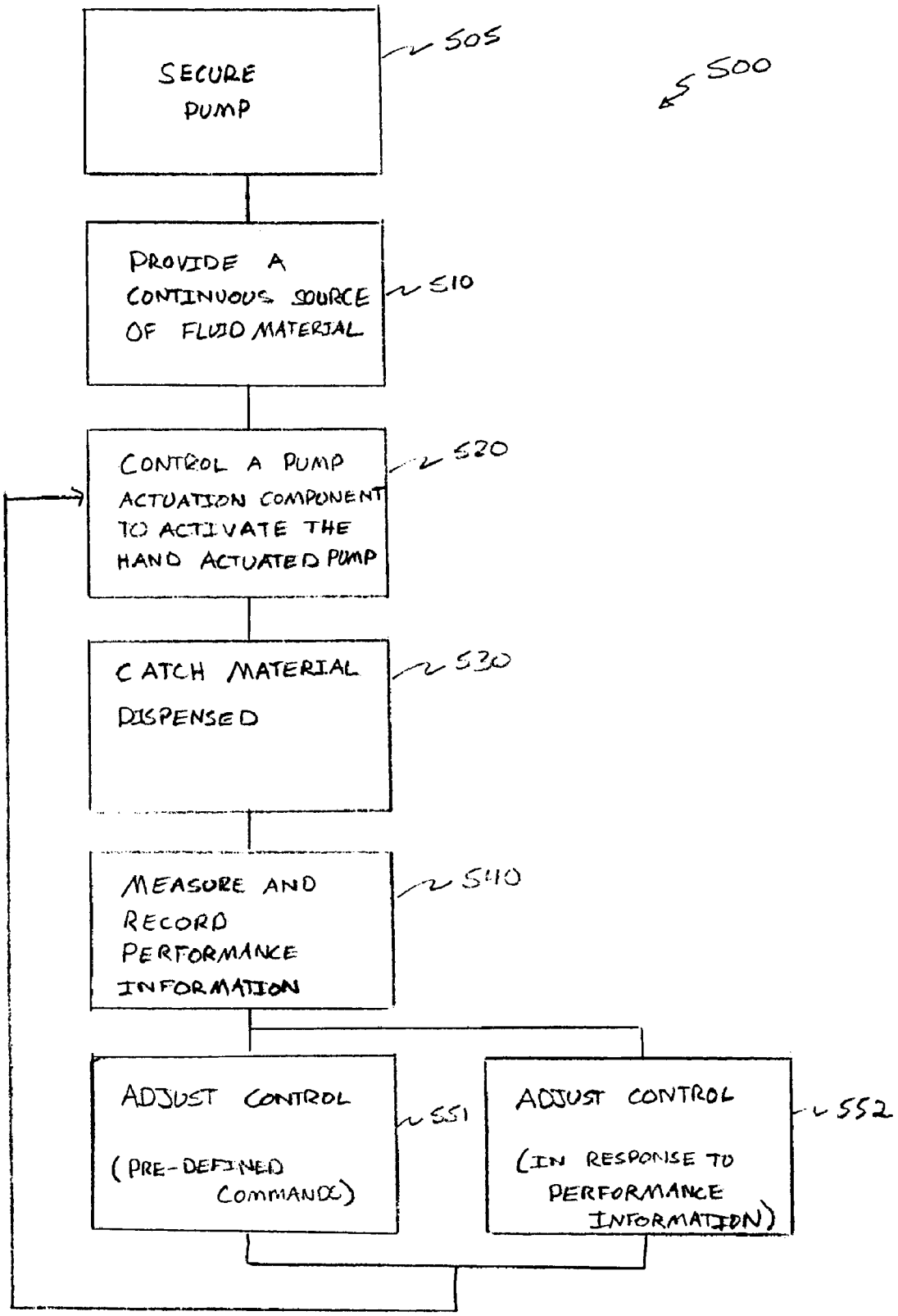
FIG. 5 is a block diagram illustrating an exemplary method for automated testing of hand actuated pumps in accordance with various embodiments of the present invention.

In accordance with yet another aspect of the present invention, FIG. 5 illustrates an exemplary method 500 for testing a pump comprising the steps of: controlling a pump actuation component (Step 520), measuring performance information (Step 540), and adjusting control of the pump actuation (e.g. Steps 551 or 552).

In accordance with one exemplary pump testing method, a pump is securely fixed in a testing station (Step 505). In one exemplary embodiment, the pump is fixed with a clamp, hook and loop fasteners, set screws, or other suitable methods of fixing an object. In addition, in various embodiments, the pump is associated with a continuous source of fluid/liquid material of the type that is to be tested with this pump (Step 510). The continuous source may, for example, be a supply tank 313. In various exemplary embodiments, the level of supply tank 313 is maintained by monitoring the quantity of fluid in the supply tank and adding fluid when the level is reduced. For example, a float mechanism can be used to maintain a fluid level. In accordance with other exemplary embodiments, a level sensor or scale is used to determine when the fluid level has become low enough to add additional fluid. Other methods of maintaining a continuous source of fluid supply may also be used.

In accordance with pump testing method 500, the hand actuated pump is actuated under the control of a controller 330. One or more actuations of the pump causes a product to be dispensed. In various exemplary embodiments, controlling the pump actuation (step 520) includes adjusting the position and/or angle of one or more actuators. Furthermore, controlling the pump actuation, may also include controlling the force applied during the actuation, the time between pump actuations, the rate of the actuation, the angle of the actuation, the completeness of the actuation, the interval between pump test cycles, and/or the number of actuations per pump test cycle.

In accordance with one exemplary step in pump testing method 500, the product dispensed by the pump is captured by a catch (step 530). The catch is configured to deliver the product to a collection tank or to return the product to the supply tank.

Method 500 further includes the measuring and/or recording of performance information relative to the actuation of the pump (Step 540). The measurement of performance information is accomplished by, for example, sensors that are configured to weigh, to sense force, to determine fluid level, and the like. For example, a level sensor may be configured to indicate the current level of product in collection tank 315. In this example, incremental changes in the product level within collection tank 315 is used to determine the output of pump 320 per actuation. By way of illustration, if the level increases by an eighth of an inch over 100 pump cycles, a look up table that correlates level increases to volume increases might indicate that half a pint had been dispensed. In this example, the average quantity dispensed per pump actuation is calculated by dividing the volume output by the number of pump actuations over the period that gave rise to the level increase.

In other exemplary embodiments, the performance information measured and/or recorded includes at least one of: the number of pump actuations, the time between pump actuations, the rate of the actuation, the angle of the actuation, the completeness of the actuation, the interval between pump test cycles, the number of actuations per pump test cycle, the amount of material dispensed by the hand actuated pump, the end of life of the pump, the length of life, what caused the end of life of the pump, the resistance of the pump to actuation, and the amount of product drip between test cycles.

What caused the end of life of the pump is often determinable, for example, based on performance information received. For example, a sudden decrease in the fluid dispensed per actuation may indicate that the nozzle is clogged. Also, a lack of resistance against the actuation may indicate that the pump trigger has physically broken. As another example, if the piston/spring breaks, it may cause a relatively large resistance to the pump actuation and thus signal the end of the pump life.

The performance information further may also include at least one of the following factors that are recorded over time: the force of the spray, the spread of the spray, the distance of the spray, the amount dispensed, and the actuation force. This performance information is communicated, for example, to controller 330. Performance information recorded over time is useful for identifying trends and, for example, making future design changes. However, the performance information may also be useful as real time feedback for controlling testing station 310.

Controller 330, or another suitable device, are configured to process the performance information and make adjustments to the actuation of the pump (e.g., steps 551 and 552). In one exemplary embodiment, the adjustment may occur in response to the performance information (step 552). For example, if spray distance begins to diminish, the actuation force or rate is increased. However, the adjustments may also include, for example, adjustments according to predefined commands and/or adjustments that are independent of the feedback of performance information (step 551). For example, the angle of actuation may be programmed to change every five cycles, simulating a change in users of the pump.

Finally, the present invention has been described above with reference to various exemplary embodiments. However, many changes, combinations and modifications may be made to the exemplary embodiments without departing from the scope of the present invention. For example, the various components may be implemented in alternate ways. These alternatives can be suitably selected depending upon the particular application or in consideration of any number of factors associated with the operation of the system. In addition, the techniques described herein may be extended or modified for use with other types of devices. These and other changes or modifications are intended to be included within the scope of the present invention.

We claim:

1. A method for automated testing of a hand actuated pump, the method comprising the steps of:

providing a continuous source of fluid material to be dispensed by the hand actuated pump;

controlling a pump actuation component to repeatedly actuate the hand actuated pump according to a preprogrammed testing cycle;

catching material dispensed from the hand actuated pump; and qualifying and recording performance information substantially simultaneous to said controlling; and adjusting, during said preprogrammed testing cycle, at least one of the following actuation variables; the time between pump actuations, the rate of the actuation, the angle of the actuation, the completeness of the actuation, the interval between pump test actuations, and the number of actuations per pump test cycle.

2. The method of claim 1, wherein said method further comprises the step of adjusting the orientation of said pump actuation component.

3. The method of claim 1 wherein said performance information includes at least one of the amount of material dispensed by the hand actuated pump, the end of life of the pump, the length of life, what caused the end of life of the pump, the resistance of the pump to actuation, and the amount of product drip between test cycles.

4. The method of claim 3, wherein the amount of material dispensed is measured by one of the amount of fluid withdrawn from a supply tank, the amount of fluid made up to the supply tank, and the amount of dispensed material in a collection tank.

5. The method of claim 3, further comprising the step of adjusting actuation variables during said preprogrammed testing cycle including at least one of: the number of pump actuations per unit of time, the angle of the actuation, the interval between pump actuations, the force of the actuation, the rate of the actuation, and the completeness of the actuation.

6. The method of claim 1, wherein said performance information includes at least one of the following factors as recorded over time the force of the spray, the spread of the spray, the distance of the spray, the amount dispensed, and the actuation force.

7. The method of claim 1, further comprising the step of electronically storing said data in at least one of a spreadsheet and a database.

8. The method of claim 1, further comprising the step of alarming on a malfunction of at least one of said hand actuated pump, said controller, said pump actuation component, said continuous source, and a sensor.

9. The method of claim 1, further comprising the step of alarming on occurrence of an event.

10. The method of claim 1, wherein said qualifying and recording of perfomance information includes simultaneous qualifying of multiple performance parameters.

11. A method for automated testing of a hand actuated pump, the method comprising the step of:

providing a continuous source of fluid material to be dispensed by the hand actuated pump;

controlling a pump actuation component to repeatedly actuate the hand actuated pump according to preprogrammed testing cycle;

catching material dispensed from the hand actuated pump;

qualifying and recording performance information substantially simultaneous to said controlling, wherein said qualifying and recording of performance information includes holding a first performance parameter constant while varying a second performance parameter.

12. The method of claim 1, wherein said performance information includes the variation in resistance to actuation over a preprogrammed range of movement of the actuator.

13. The method of claim 1, wherein said performance information includes at least one of the amount of product drip during pump actuation and the amount of product drip between successsive pump actuations.

14. The method of claim 1, wherein said performance information includes the force required to move the actuator through preprogrammed increments of a range of movement.

15. A method of testing a hand actuated pump, comprising the steps of: dispensing a liquid drawn from a reservoir, collecting the liquid from said dispensing step;

recirculating the liquid from said collecting step through the reservoir and the hand actuated pump;

mechanically and repetitively actuating the hand actuated pump according to a preprogrammed testing cycle; and measuring and recording real-time performance information related to said actuating of the hand actuated pump.

16. The method of claim 15 further comprising the step of variably actuating the hand activated pump during at least one of a single pump actuation and a cycle of repeated pump actuations.

17. A pump testing system for testing a hand actuated pump, the pump testing system comprising:

a testing station further comprising at least one pump actuation component that is configured to actuate the hand actuated pump;

a supply tank configured to serve as a fluid source for the hand actuated pump;

a collection tank configured to serve as a collection reservoir for material expelled from the hand actuated pump;

a controller configured to automatically control said at least one pump actuation component, wherein said controller is configured to repetitively actuate the hand actuated pump according to a preprogrammed testing cycle; and a sensor configured to quantify performance information associated with said preprogrammed testing cycle, said performance information including least one of: the number of actuations, the rate of the pump actuation, the rate of the pump actuation, the completeness of the pump actuation, the interval between pump test cycles, the amount of fluid dispensed by the hand actuate pump, the length of life of the hand actuated pump what caused the end of life of the pump, and the amount of product drip between pump test cycles.

18. The pump tester of claim 17, wherein said at least one pump activation component comprises one or more devices that are configured to test at least one of: horizontally actuated pumps, vertically actuated pumps, and pumps that are actuated at other angles.

19. The pump tester of claim 17, wherein said at least one pump activation component is configured to actuate both push type pumps and pull type pumps.

20. The pump tester of claim 17, wherein said at least one pump activation component is configured to be variably oriented to change the angle of an actuation force.

21. The pump tester of claim 17, wherein said controller is configured to record performance information related to said actuating of said pump.

22. The pump tester of claim 17, wherein said performance information include at least one of the following factors as recorded over time: the force of the spray, the spread of the spray, the distance of the spray, the amount dispensed, and the actuation force.

23. The pump tester of claim 22, wherein to amount of fluid dispensed is measured by one of: the amount withdrawn from the supply tank, the amount made up to said supply tank, the amount in said collection tank, and the weight of either tank.

24. The pump tester of claim 17, wherein said controller is further configured to electronically store said data in at least one of a spreadsheet and a database.

25. The pump rester of claim 17, wherein said controller is further configured to adjust, according to said preprogrammed testing cycle, at least one of the following: the number of pump actuations per successive pump test cycle, the time between pump actuations, the number of pump actuation per unit of time, the angle of the pump actuation, the interval between successive pump test cycle, the force of the actuation, the rate of the actuation, and the completeness of the actuation.

26. The pump tester of claim 17, wherein said at least one actuation component is configured to teat at least one of: a plunger type pump, a trigger type pump, or a contact-less type of pump.

27. The pump tester of claim 17, wherein said controller is further configured to alarm on occurrence of an event.

28. A pump tester for testing a hand actuated pump, the pump tester comprising:

at least one pump actuation component configured to actuate the hand actuated pump, wherein said hand actuated pump is a wall-mounted pump and wherein said at least one pump actuation component is configured to be automatically controlled by a controller, and wherein said controller is configured to cause said at least one pump actuation component to repetitively actuate the hand actuated pump according to a preprogrammed testing cycle to cause the hand actuated pump to draw a fluid from a supply tank and to expel material into a collection tank.

29. The pump tester of claim 28, wherein said controller is configured to measure the force required to move said actuation component a set distance, over multiple actuations.

* * * * *